US009623537B2

(12) United States Patent
Choi et al.

(10) Patent No.: US 9,623,537 B2
(45) Date of Patent: Apr. 18, 2017

(54) APPARATUS FOR TREATING SURFACE OF RADOME

(71) Applicants: Byung Geun Choi, Busan (KR); Young Jin Lee, Busan (KR)

(72) Inventors: Byung Geun Choi, Busan (KR); Young Jin Lee, Busan (KR); Dong Seon Lee, Gimhae-si (KR); Man Soo Kim, Changwon-si (KR); Seong Bin Kim, Changwon-si (KR)

(73) Assignee: Byung Geun CHOI, Busan (KR)

( * ) Notice: Subject to any disclaimer, the term of this patent is extended or adjusted under 35 U.S.C. 154(b) by 0 days.

(21) Appl. No.: 14/785,243

(22) PCT Filed: Apr. 15, 2014

(86) PCT No.: PCT/KR2014/003237

§ 371 (c)(1),
(2) Date: Oct. 16, 2015

(87) PCT Pub. No.: WO2014/171697

PCT Pub. Date: Oct. 23, 2014

(65) Prior Publication Data

US 2016/0074992 A1 Mar. 17, 2016

(30) Foreign Application Priority Data

Apr. 17, 2013 (KR) ..... 10-2013-0042283

(51) Int. Cl.
*B24B 41/06* (2012.01)
*B24B 55/06* (2006.01)
(Continued)

(52) U.S. Cl.
CPC ..... *B24B 41/067* (2013.01); *B24B 11/00* (2013.01); *B24B 19/08* (2013.01); *B24B 19/26* (2013.01); *B24B 55/06* (2013.01)

(58) Field of Classification Search
CPC ..... B24B 41/067; B24B 11/00; B24B 19/08; B24B 19/26; B24B 55/06
(Continued)

(56) References Cited

U.S. PATENT DOCUMENTS 2,184,175 A * 12/1939 Blake ..... B24B 5/16 451/227
3,110,987 A * 11/1963 Arneson ..... B24B 11/10 451/268
(Continued)

FOREIGN PATENT DOCUMENTS

JP 2513426 B2 7/1996
JP 8-252756 A 10/1996
(Continued)

*Primary Examiner* — Robert Rose
(74) *Attorney, Agent, or Firm* — Birch, Stewart, Kolasch & Birch, LLP

(57) ABSTRACT

The present invention provides an apparatus for treating the surface of a radome, comprising: a rotary driving unit; a vacuum suction unit; a vertical driving unit; and a surface treatment unit. The rotary driving unit comprises: a rotary shaft; and a driving motor, installed at a predetermined portion spaced apart from the rotary shaft. The vacuum suction unit comprises: a plurality of first hydraulic cylinders positioned on the rotary shaft in the circumferential direction; and a suction plate equipped at an end of a piston rod of each of the first hydraulic cylinders. The vertical driving unit comprises: a mounting plate having a hole formed in the central portion thereof. The surface treatment unit comprises: a support column vertically installed on a predetermined portion spaced apart from the mounting plate; and a support arm.

6 Claims, 2 Drawing Sheets

(51) Int. Cl.

| | |
|---|---|
| ***B24B 19/26*** | (2006.01) |
| ***B24B 11/00*** | (2006.01) |
| ***B24B 19/08*** | (2006.01) |

(58) Field of Classification Search
USPC ..... 451/50, 439, 268, 269
See application file for complete search history.

(56) References Cited

U.S. PATENT DOCUMENTS

| | | | | |
|---|---|---|---|---|
| 3,609,918 | A * | 10/1971 | Hillman | B24B 11/10 451/268 |
| 3,714,703 | A * | 2/1973 | Maples | B23B 5/40 29/560 |
| 5,542,874 | A | 8/1996 | Chikaki | |
| 6,537,139 | B2 | 3/2003 | Ohmori | |

FOREIGN PATENT DOCUMENTS

| | | | |
|---|---|---|---|
| JP | 2003-116215 | A | 4/2003 |
| JP | 2007-223010 | A | 9/2007 |
| KR | 10-0183905 | B1 | 5/1999 |
| KR | 10-0464138 | B1 | 1/2005 |
| KR | 10-0509791 | B1 | 8/2005 |
| KR | 10-0742657 | B1 | 7/2007 |
| KR | 10-0805524 | B1 | 2/2008 |
| KR | 10-2009-0099489 | A | 9/2009 |
| KR | 10-2011-0020580 | A | 3/2011 |

* cited by examiner

APPARATUS FOR TREATING SURFACE OF RADOME

TECHNICAL FIELD

The present invention relates to an apparatus for treating a surface. More particularly, the present invention relates to an apparatus for treating a surface of radome including: a rotary driving unit provided with a rotary shaft; and a driving motor installed at a predetermined portion spaced apart from the rotary shaft, the driving motor providing a rotational force to the rotary shaft; a vacuum suction unit provided with a plurality of first hydraulic cylinders arranged over the rotary shaft and spaced apart from each other at predetermined intervals in a circumferential direction of the radome; and a suction plate provided at an end of a piston rod of each of the first hydraulic cylinders, the suction plate being in close contact with an inner circumferential surface of the radome; a vertical driving unit provided with a mounting plate having a hole formed in a central portion thereof, with the rotary shaft passing through the hole; and a plurality of second hydraulic cylinders mounted under the mounting plate and vertically lifting or lowering the mounting plate that the radome sits on, wherein the vertical driving unit rotates with the rotary driving unit; a surface treatment unit provided with a support column vertically installed on a predetermined portion spaced apart from the mounting plate; and a support arm, wherein a first end of the support arm is provided with an adhesion plate that comes into contact with the surface of the radome, and a second end of the support arm is vertically lifted or lowered along a surface of the support column.

BACKGROUND ART

Generally, a weather radar is mounted in the nose of an airplane located in front of the cockpit of the airplane and supplies essential weather information to a pilot for safe aviation of the airplane. The weather radar is enclosed by a complex structure called a radome (a radar dome), thereby being safely prevented from hindrances such as heat, humidity, and foreign objects.

A radome is required to be configured in such a manner that the radome protects a weather radar from the outside, and permits the penetration of all electromagnetic waves transmitted over a broad frequency bandwidth so that the weather radar can easily identify signals transmitted from the outside. Furthermore, considering the high-speed flight of an airplane, the radome is required to be prevented from being easily abraded by hail, sand, etc. To achieve an above-mentioned object, a commercial airplane flying at a subsonic speed generally uses a radome constructed of synthetic resin materials.

The radome of synthetic resin materials has an advantage in that it is light and sturdy, and thus allows a weather radar to operate without being hindered. However, when flights are long, the radome of the airplane obtains many scratches on the surface thereof caused by foreign objects such as sand and hail. Scratches generally do not directly affect the operation of a weather radar, but if a foreign object such as excrement of a bird excessively accumulates on scratches, the foreign objects may cause the weather radar to malfunction. Accordingly, when an airplane has flown a predetermined number of hours, scrubbing, cleaning, or polishing is performed on the surface of the radome of the airplane.

Since a radome is configured in a hemispheric shape, it is difficult to perform surface treatment thereon by using a mechanical device. Accordingly, operations such as scrubbing, cleaning, or polishing the surface of the radome are being performed by a worker using a scrubbing tool shouldered by the worker. Accordingly, the result and efficiency of the operation cannot be maintained at predetermined level, and vary depending on proficiency of the worker. In this case, excessive scrubbing may be performed on a certain portion of a radome, so that the certain portion may form cracks. Accordingly, surface treatments performed manually may lead to an airplane accident.

If a radome is configured in a spherical shape, the issue of treating the surface of the radome described above is applied not only to a normal radar and a weather radar mounted on moving objects such as an airplane, but also to a weather radar fixed on the ground. Accordingly, a solution to address the issue is being extremely required.

DISCLOSURE

Technical Problem

Accordingly, the present invention has been made keeping in mind the above problems occurring in the related art, and the present invention is intended to propose an apparatus capable of scrubbing, cleaning, and polishing the surface of a radome with a desired accuracy.

Technical Solution

To address the above-mentioned object, the present invention provides an apparatus for treating the surface of a radome including: a rotary driving unit 10 provided with a rotary shaft 120; and a driving motor 160 installed at a predetermined portion spaced apart from the rotary shaft 120, the driving motor providing a rotational force to the rotary shaft 120; a vacuum suction unit 20 provided with a plurality of first hydraulic cylinders 220 arranged over the rotary shaft 120 and spaced apart from each other at predetermined intervals in a circumferential direction of the radome d; and a suction plate 260 provided at an end of a piston rod 222 of each of the first hydraulic cylinders 220, the suction plate being in close contact with an inner circumferential surface of the radome d; a vertical driving unit 30 provided with: a mounting plate 320 having a hole 322 formed in a central portion thereof, with the rotary shaft 120 passing through the hole; and a plurality of second hydraulic cylinders 360 mounted under the mounting plate 320 and vertically lifting or lowering the mounting plate 320 that the radome d sits on, wherein the vertical driving unit rotates with the rotary driving unit 10; a surface treatment unit 40 provided with a support column 420 vertically installed on a predetermined portion spaced apart from the mounting plate 320; and a support arm 460, wherein a first end of the support arm is provided with an adhesion plate 480 that comes into contact with the surface of the radome d, and a second end of the support arm is vertically lifted or lowered along a surface of the support column 420.

The first hydraulic cylinders 220 of the vacuum suction unit 20 may be mounted on a locking plate 130 provided on the rotary shaft 120.

A driving screw 410 may be provided at a predetermined portion spaced apart from the support column 420 of the surface treatment unit 40, and the second end of the support arm 460 may be vertically lifted or lowered by a driving nut engaged with the driving screw 410.

The second end of the support arm 460 may be locked to a first portion of a driving plate 430, the driving plate being engaged with the driving screw 410 and being lifted or lowered in vertical directions.

The driving plate 430 may be provided with a third hydraulic cylinder 450 at a second portion thereof, the third hydraulic cylinder bringing the adhesion plate 480 of the support arm 460 into close contact with the surface of the radome d.

The support arm 460 may be connected to a release pump 470, the release pump releasing dust collected in the adhesion plate 480 to an outside.

Advantageous Effects

The present invention is intended to propose an apparatus for treating a surface of a radome and is provided in such a manner that the apparatus rotates the radome while bringing a suction plate into close contact with the inner circumferential surface of a radome, and bringing an adhesion plate into close contact with the outer surface of the radome. Accordingly, the apparatus can efficiently perform the operation of scrubbing or polishing the surface of the radome, and enables unskilled workers to easily perform the operation regardless of proficiency.

In addition, the apparatus of the present invention can bring the adhesion plate into close contact with the surface of the radome by using a predetermined force exerted by an additional hydraulic cylinder, so that even unskilled workers can evenly perform the operation of scrubbing or polishing the surface of the radome. Furthermore, by properly adjusting the force exerted by the hydraulic cylinder, the result of the operation of treating the surface of the radome can remain consistent and the depth of scrubbing the surface of the radome or the degree of polishing the surface thereof can be freely changed.

BEST MODE

An exemplary embodiment of the present invention is illustrated in detail below by referring to the accompanying drawings. In illustrating the embodiment of the present invention, further detailed description will be omitted about matters other than what have a direct relationship with the technological features of the present invention, or about the techniques that are well-known to those skilled in the art belonging to the present invention.

Figure 1:
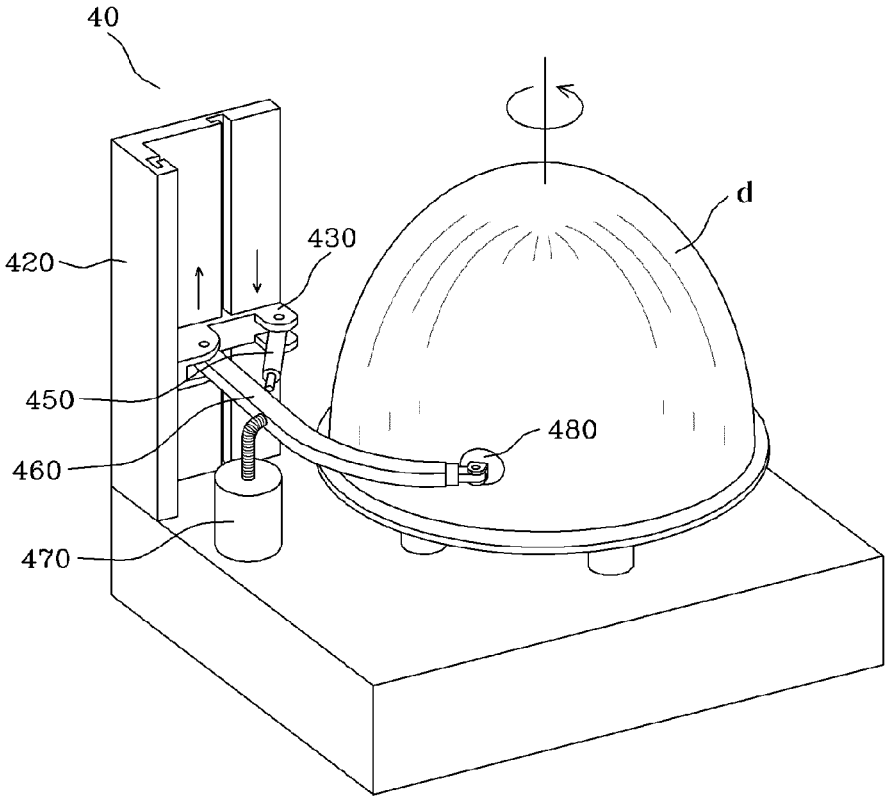
FIG. 1 is a perspective view showing an appearance of an apparatus for treating a surface of a radome according to the present invention.
Figure 2:
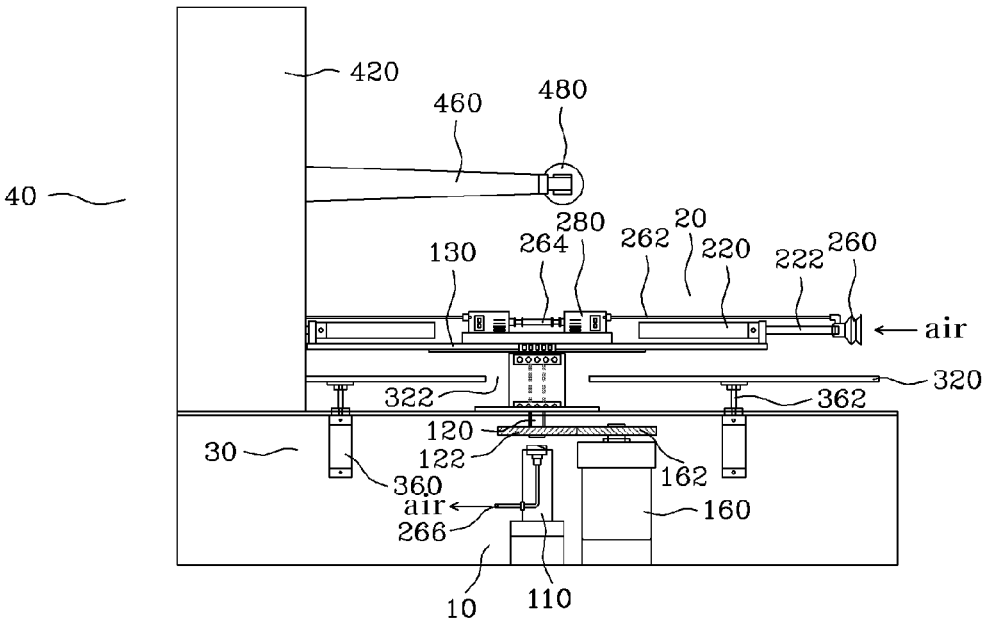
FIG. 2 is a side sectional view showing the apparatus for treating the surface of the radome according to the present invention.
Figure 3:
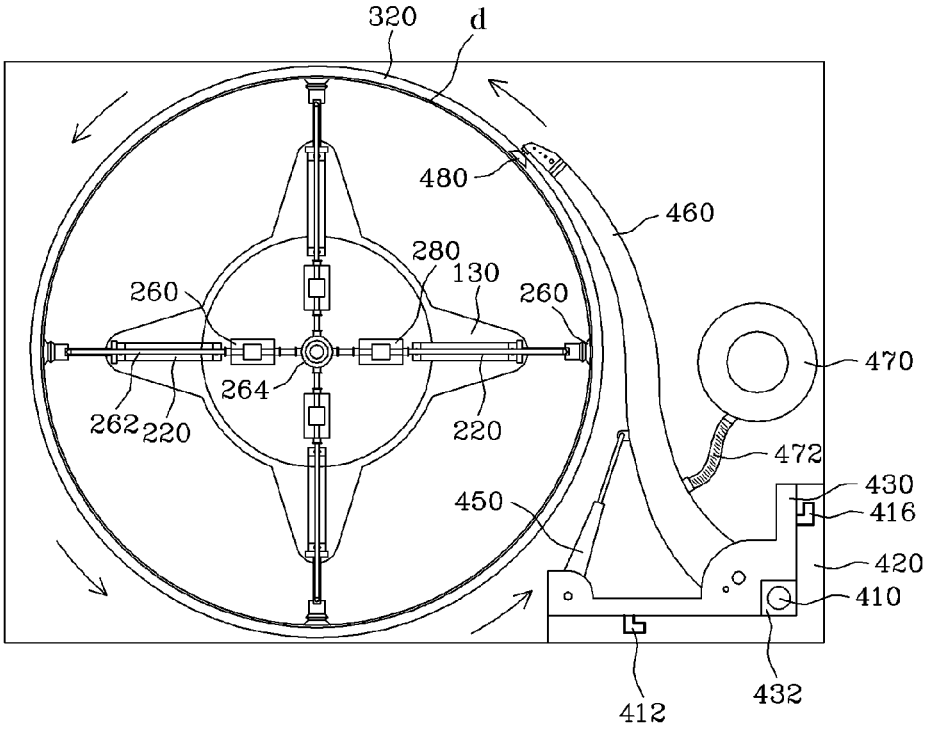
FIG. 3 is a plan sectional view showing the apparatus for treating the surface of the radome according to the present invention.

FIG. 1 is a perspective view showing an appearance of an apparatus for treating a surface of a radome according to the present invention; FIG. 2 is a side sectional view showing the apparatus for treating the surface of the radome according to the present invention; and FIG. 3 is a plan sectional view showing the apparatus for treating the surface of the radome according to the present invention. As shown in the accompanying drawings, an apparatus for treating a surface of a radome according to the present invention includes: a rotary driving unit 10; a vacuum suction unit 20; a vertical driving unit 30; and a surface treatment unit 40.

The rotary driving unit 10 includes: a rotary shaft 120; and a driving motor 160 installed at a predetermined portion spaced apart from the rotary shaft 120, the driving motor providing a rotational force to the rotary shaft 120. The rotary shaft 120 may be supported by a central shaft 110 vertically installed along the central axis of locking plate. A lower end of the rotary shaft 120 may be provided with the rotary gear 122, and the rotary gear 122 is engaged with a driving gear 162 provided on the driving motor 160, wherein the driving motor may transmit the rotational force to the rotary shaft. However, the details of configuration of transmitting the rotational force may be changed in various ways different from a configuration presented above.

On one hand, in the accompanying drawings, the rotary driving unit 10 is fixed to the housing 1 constructed in rectangular shape. However, the rotary driving unit according to the present invention is not limited to this configuration, but does not exclude the configuration of a rotary driving unit that may be fixed on the ground, or may be fixed in a movable structure, the bottom of which has a plurality of wheels mounted thereto.

The vacuum suction unit 20 may include: first hydraulic cylinders 220; and a suction plate 260 provided at the end of a piston rod 222 of each of the first hydraulic cylinders 220. The first hydraulic cylinders 220 may be configured in plural numbers, and in this case, it is preferred that the first hydraulic cylinders 220 are arranged over the rotary shaft 120 and spaced apart from each other at predetermined intervals in a circumferential direction of the radome. If each of the first hydraulic cylinders is operated and pushes each of the piston rods, the suction plate provided at the end of the piston rod is brought into close contact with the inner circumferential surface of the radome d. To efficiently bring the suction plate into close contact with the inner circumferential surface of the radome, the suction plate 260 is preferred to be made of compressible materials.

Furthermore, with the suction plate 260 being in close contact with an inner circumferential surface of the radome d, air filled in a space located between the suction plate and the inner circumferential surface of the radome is released to the outside by a vacuum pump 280. To release the air, an air duct 262 is connected between the suction plate 260 and the vacuum pump 280, and the air duct 262 is connected to a junction pipe 264 installed at a central portion located between vacuum pumps 280, and the junction pipe is connected to a release tube 266 installed in the central shaft 110. Accordingly, the air can be released through the release tube to the outside. The configuration of the air duct, the junction pipe, and the release tube may be variously changed.

In addition, the present invention proposes the vacuum suction unit 20 including: a locking plate 130 mounted on the rotary shaft 120, and the first hydraulic cylinders 220 and the vacuum pumps 280 mounted on the locking plate 130. In this case, though the configuration of the locking plate may be variously changed, since the suction plate is required to be kept in close contact with the inner circumferential surface of the radome, the locking plate is required to be constructed to rotate with the rotary shaft.

The vertical driving unit 30 includes: a mounting plate 320; and a plurality of second hydraulic cylinders 360 mounted under the mounting plate 320. The mounting plate 320 is a part that the radome sits on to be operated, wherein the mounting plate 320 has a hole formed in a central portion thereof, with the rotary shaft passing through the hole. It is preferred that the mounting plate is configured in a circular plate shape corresponding to the shape of a plan section of the radome.

If the housing 1 is configured as shown in the accompanying drawings, according to the exemplary embodiment of the present invention, the second hydraulic cylinders 360 are mounted to the housing 1 and spaced apart from each other at predetermined intervals. Furthermore, the mounting plate 320 is configured to be located on the end of each of the pistons 362 of the second hydraulic cylinders 360. In addition, the mounting plate 320 vertically lifts or lowers the radome d that sits on the mounting plate while each of the piston rods 362 is lifted or lowered, and while the radome d is rotated, the mounting plate is rotated.

The surface treatment unit 40 includes: the support column 420; and the support arm 460 provided with an adhesion plate 480. The support column 420 guides the vertical movement of the support arm 460, and is vertically installed on a predetermined portion spaced apart from the mounting plate 320 so that the adhesion plate 480 can efficiently perform treating the surface of the radome d. The shape of the support column may be configured in a vertical bar shape different from a shape presented in the drawings.

The adhesion plate 480 is a part that performs an operation such as scrubbing, cleaning, or polishing the surface of the radome d, and it is preferred that the adhesion plate is provided at a first end of the support arm 460. According to the kind of an operation performed such as scrubbing, cleaning, or polishing, the material of the adhesion plate 480 may be replaced and mounted at a first end of the support arm to be used.

The support arm 460 may be screwed to a driving screw 410, thereby being lifted or lowered. In this case, it is preferred that the driving screw is provided at a predetermined portion spaced apart from the support column 420, and a second end of the support arm 460 may be provided with a driving nut engaged with the driving screw. In this case, it is preferred that a driving motor is provided under the driving screw to rotate the driving screw, and when the driving screw is rotated by the operation of the driving motor, the driving nut engaged with the driving screw vertically moves, and the support arm is lifted or lowered. Details about the configuration of the driving screw and the driving nut, and a reciprocal operation between them are widely known in related fields, thus a detailed description about them will be omitted.

On one hand, as shown in the accompanying drawings, the support arm 460 may be configured to be locked to a driving plate 430, thereby being lifted or lowered along the support column 420 in vertical directions. In this case, the second end of the support arm 460 is locked to a driving plate 430, and the driving plate 430 is vertically lifted or lowered along the support column by the operation of the driving screw 410. To lift or lower the driving plate, the driving screw 410 is vertically provided at a predetermined portion spaced apart from the support column 420, and a driving nut 432 engaged with the driving screw 410 may be provided on the second end of the support arm 460. Each of reference numerals 412, 416 not described is a sliding guide, and the sliding guide may be an LM guide widely used in related fields.

In addition, the present invention presents the support arm 460 supported by a third hydraulic cylinder 450. Force exerted by the third hydraulic cylinder 450 is applied to the support arm 460 through a piston rod 452, and thus the support arm 460 is pulled to the outer surface of the radome d, thereby bringing the adhesion plate 480 into close contact with the outer surface of the radome d. That is, a third hydraulic cylinder works as a means to bring an adhesion plate into close contact with the outer surface of a radome. If the driving plate 430 is added, the third hydraulic cylinder 450 is mounted on a second portion of the driving plate.

Additionally, the support arm 460 may be further provided with a release pump 470. The release pump 470 is a means to release dust collected in the adhesion plate 480 to the outside, and it is preferred that a release hose 472 is connected between the release pump and the adhesion plate. In the drawings, the configuration constructed in such a manner that the release hose penetrates the support arm, and communicates with the adhesion plate is presented just as an example.

The operation of the present invention constructed as described above will be simply described referring to the accompanying drawings and the above-mentioned description.

First, by operating each of the second hydraulic cylinders 360 of the vertical driving unit 30, the mounting plate 320 is vertically lifted to a desired height, and the radome d, the surface of which requires treatment, is located on the mounting plate 320. Next, by operating each of the first hydraulic cylinders 220 of the vacuum suction unit 20, the suction plate 260 is brought into close contact with the inner circumferential surface of the radome d. In this case, the degree of the suction plate being in close contact with the inner circumferential surface of the radome may be changed depending on the size (weight) of the radome and the degree of operation (the degree of scrubbing).

When each of the suction plate 260 is brought into close contact with the inner circumferential surface of the radome, the vacuum pump 280 is operated, thereby releasing air to the outside, which is filled in a space located between the suction plate and the inner circumferential surface of the radome. As the air in the suction plate is released to the outside, a space located between the suction plate and the inner circumferential surface of the radome d approaches a vacuum state, and thus the suction plate contacts the radome more closely. If the suction plate 260 closely contacts the radome d, the surface treatment unit 40 is vertically lifted, thereby bringing the adhesion plate 480 provided at the first end of the support arm 460 into close contact with the surface of the radome d.

The following is the operation process of the adhesion plate 480. If the driving motor is operated by a transmitted signal, the driving screw 410 provided at a predetermined portion spaced apart from the support column 420 is rotated, and accordingly, the driving nut 432 engaged with the driving screw 430 vertically moves through the driving screw 410 a distance corresponding to the rotation number of the driving screw. Since the second end of the support arm 460 is locked to a driving plate 430 moving with the driving nut 432, the support arm 460 vertically moves and stops at a predetermined height according to the rotation degree of the driving screw 410. In the state, if the third hydraulic cylinder 450 is operated and pulls the support arm 460 to the outer surface of the radome, the adhesion plate 480 is brought into contact with the outer surface of the radome d by force exerted by the operation of the third hydraulic cylinder.

Accordingly, the inner circumferential surface of the radome d is brought into close contact with the suction plate 260, and a predetermined portion of the outer surface of the radome closely contacts the adhesion plate 480. In the state, when the driving motor 160 is operated, the rotational force of the driving motor 160 is transmitted to the rotary shaft

120, and the radome being in close contact with the suction plate 260 over the rotary shaft 120 slowly is rotated with the rotary shaft. When the rotary shaft 120 is rotated, the mounting plate 320 that the radome sits on is also rotated with the rotary shaft.

On one hand, since the adhesion plate 480 pulled to the outer surface of the radome by the third hydraulic cylinder 450 is not related to the rotational movement of the rotary shaft 120, the adhesion plate 480 is kept at a predetermined position thereof, though the radome d is rotated with the rotary shaft 120. That is, though the adhesion plate is kept at the predetermined position thereof without being moved, due to the rotational movement of the radome in a circumferential direction, the operation of scrubbing or polishing is efficiently performed on the surface of the radome. Particularly, the adhesion plate remains pulled by a predetermined force of the third hydraulic cylinder, thereby uniformly performing the operation of treating all portions of the surface of the radome. Additionally, by adjusting strength of the force exerted by the third hydraulic cylinder, the adhesion plate 480 can maintain the uniformity of operation result thereof, and can randomly adjust the degree of treating the surface of the radome (degree of scrubbing or polishing).

After the treatment of a predetermined portion of the radome (a circumference having the same vertical height) is completed, the vertical height of the support arm 460 is gradually adjusted (adjusted in an upward or downward direction as much as predetermined vertical height), and thus the treatment of the outer surface of the radome can be performed consecutively and efficiently. Though the treatment of the surface of the radome mentioned above is performed observing the degree to which the surface of the radome is treated, it may also be performed in such a manner set in advance such that after a predetermined amount of time passes, the vertical height of the support arm is automatically changed.

Although the above description is limited to the preferred embodiment of the present invention, it is just an example, and those skilled in the art will appreciate that various modifications, additions and substitutions are possible, without departing from the scope and spirit of the invention as disclosed in the accompanying claims.

The invention claimed is:

1. An apparatus for treating a surface of a radome, the apparatus comprising:

a rotary driving unit provided with: a rotary shaft; and a driving motor installed at a predetermined portion spaced apart from the rotary shaft, the driving motor providing a rotational force to the rotary shaft;

a vacuum suction unit provided with: a plurality of first hydraulic cylinders arranged over the rotary shaft and spaced apart from each other at predetermined intervals in a circumferential direction of the radome; and a suction plate provided at an end of a piston rod of each of the first hydraulic cylinders, the suction plate being in close contact with an inner circumferential surface of the radome;

a vertical driving unit provided with: a mounting plate having a hole formed in a central portion thereof, with the rotary shaft passing through the hole; and a plurality of second hydraulic cylinders mounted under the mounting plate and vertically lifting or lowering the mounting plate that the radome sits on;

a surface treatment unit provided with: a support column vertically installed on a predetermined portion spaced apart from the mounting plate; and a support arm, wherein a first end of the support arm is provided with an adhesion plate that comes into contact with the surface of the radome, and a second end of the support arm is vertically lifted or lowered along a surface of the support column.

2. The apparatus of claim 1, wherein the first hydraulic cylinders of the vacuum suction unit are mounted on a locking plate provided on the rotary shaft.

3. The apparatus of claim 1, wherein a driving screw is provided at a predetermined portion spaced apart from the support column of the surface treatment unit, and the second end of the support arm is vertically lifted or lowered by a driving nut engaged with the driving screw.

4. The apparatus of claim 3, wherein the second end of the support arm is locked to a first portion of a driving plate, the driving plate being engaged with the driving screw and being lifted or lowered in vertical directions.

5. The apparatus of claim 4, wherein the driving plate is provided with a third hydraulic cylinder at a second portion thereof, the third hydraulic cylinder bringing the adhesion plate of the support arm into close contact with the surface of the radome.

6. The apparatus of claim 1, wherein the support arm is connected to a release pump, the release pump releasing dust collected in the adhesion plate to an outside.

* * * * *